US010472729B2

(12) United States Patent
Strock et al.

(10) Patent No.: US 10,472,729 B2
(45) Date of Patent: Nov. 12, 2019

(54) ABRASIVE TIP BLADE MANUFACTURE METHODS

(71) Applicant: United Technologies Corporation, Farmington, CT (US)

(72) Inventors: Christopher W. Strock, Kennebunk, ME (US); James O. Hansen, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 15/988,109

(22) Filed: May 24, 2018

(65) Prior Publication Data

US 2018/0274120 A1 Sep. 27, 2018

Related U.S. Application Data

(63) Continuation of application No. 14/729,534, filed on Jun. 3, 2015, now Pat. No. 9,982,358.

(60) Provisional application No. 62/007,592, filed on Jun. 4, 2014.

(51) Int. Cl.

| | |
|---|---|
| ***C25D 11/16*** | (2006.01) |
| ***F01D 5/02*** | (2006.01) |
| ***F01D 5/28*** | (2006.01) |
| ***F01D 25/24*** | (2006.01) |
| ***C25D 11/24*** | (2006.01) |

(Continued)

(52) U.S. Cl.

CPC ..... *C25D 11/16* (2013.01); *C25D 11/022* (2013.01); *C25D 11/18* (2013.01); *C25D 11/24* (2013.01); *F01D 5/02* (2013.01); *F01D 5/20* (2013.01); *F01D 5/286* (2013.01); *F01D 5/288* (2013.01); *F01D 25/24* (2013.01); *F05D 2220/32* (2013.01); *F05D 2230/31* (2013.01); *F05D 2230/90* (2013.01); *F05D 2240/307* (2013.01); *F05D 2240/31* (2013.01);

(Continued)

(58) Field of Classification Search

CPC . F01D 5/20; F01D 5/286; F01D 5/288; F01D 5/02; F01D 25/24; C25D 11/16; C25D 11/18; C25D 11/24; C25D 11/022; F05D 2230/31; F05D 2300/506; F05D 2250/61; F05D 2240/31

See application file for complete search history.

(56) References Cited

U.S. PATENT DOCUMENTS

| | | |
|---|---|---|
| 3,575,427 A | 4/1971 | Lapac et al. |
| 5,756,217 A | 5/1998 | Schroder et al. |

(Continued)

FOREIGN PATENT DOCUMENTS

| | | |
|---|---|---|
| EP | 2540978 A2 | 1/2013 |
| GB | 902645 A | 8/1962 |

OTHER PUBLICATIONS

European Office action for EP Patent Application No. 15170693.4, dated Aug. 27, 2018.

(Continued)

*Primary Examiner* — Moshe Wilensky

(74) *Attorney, Agent, or Firm* — Bachman & LaPointe, P.C.

(57) ABSTRACT

A method is provided for manufacturing a blade. The blade comprises an airfoil (100) having: a root end and a tip (106); a metallic substrate (102) along at least a portion of the airfoil; and an anodized layer (154). The method comprises roughening the tip to form protrusions (158'; 402') and anodizing to form the anodized layer so that the protrusions form an abrasive (156; 400).

9 Claims, 8 Drawing Sheets

(51) Int. Cl.

| | |
|---|---|
| ***C25D 11/18*** | (2006.01) |
| ***F01D 5/20*** | (2006.01) |
| ***C25D 11/02*** | (2006.01) |

(52) U.S. Cl.
CPC .... *F05D 2250/61* (2013.01); *F05D 2300/121* (2013.01); *F05D 2300/2112* (2013.01); *F05D 2300/506* (2013.01)

(56) References Cited

U.S. PATENT DOCUMENTS

| | | | |
|---|---|---|---|
| 6,334,617 | B1 | 1/2002 | Putnam et al. |
| 8,020,875 | B2 | 9/2011 | Putnam et al. |
| 2007/0090152 | A1 | 4/2007 | Meier et al. |
| 2013/0004328 | A1 | 1/2013 | Wrabel et al. |
| 2013/0149163 | A1 | 6/2013 | Parkos, Jr. et al. |
| 2013/0156588 | A1 | 6/2013 | Murdock et al. |
| 2014/0010663 | A1 | 1/2014 | Parkos, Jr. et al. |
| 2014/0163717 | A1 | 6/2014 | Das et al. |

OTHER PUBLICATIONS

Orhan Sahin et al., Electrospark Deposition: Mass Transfer, Intech, Jul. 7, 2011, Croatia.
European Search Report for EP Patent Application No. 15170693.4, dated Sep. 25, 2015.
U.S. Office action dated Sep. 6, 2017 for U.S. Appl. No. 14/729,534.
European Office Action dated Jul. 12, 2019 for European Patent Application No. 15170693.4.

ABRASIVE TIP BLADE MANUFACTURE METHODS

CROSS REFERENCE TO RELATED APPLICATIONS

This is a continuation of U.S. patent application Ser. No. 14/729,534, filed Jun. 3, 2015, entitled "Abrasive Tip Blade Manufacture Methods" and benefit is claimed of U.S. Patent Application No. 62/007,592, filed Jun. 4, 2014, and entitled "Abrasive Tip Blade Manufacture Methods", the disclosures of which applications are incorporated by reference herein in their entireties as if set forth at length.

BACKGROUND

The disclosure relates to blades and rub coatings. More particularly, the disclosure relates to abrasive blade tips for cooperating with abradable coatings on turbomachines such as gas turbine engines.

Abradable coatings (rub coatings) protect moving parts from damage during rub interaction and wear to establish a mating surface to the moving parts with smallest possible clearance. The coatings are used in turbomachines to interface with the tips of a rotating blade stage, tips of cantilevered vanes and knife edge seals.

In an exemplary turbomachine such as a gas turbine engine, more particularly, a turbofan engine, coatings may be used to interface with the blade tips of fan blade stages, compressor blade stages, and turbine blade stages. Because temperature generally increases through the fan and compressor and is yet much higher in the turbine, different blade materials, surrounding case materials, and coating materials may be desired at different locations along the engine.

With relatively low temperatures in the fan and compressor sections, relatively low temperature materials may be used for their blades and the surrounding cases (at least through upstream (lower pressure) portions of the compressor). The exemplary blade materials in such lower temperature stages may be aluminum alloy, titanium alloy, carbon fiber or other composite, combinations thereof, and the like. Similarly, relatively lower temperature case materials may be provided. Particularly because the case material is not subject to the centrifugal loading that blades are, even lower temperature capability materials may be used (e.g., aramid or other fiber composites) in the case than in the blades.

US Patent Application Publication 20130156588 A1, published Jun. 20, 2013, and entitled "Electrical grounding for fan blades", discloses blades having polyurethane-coated aluminum substrates.

It is known to use a coating along the inboard or inner diameter (ID) surface of the case component to interface with the blade tips. Such coatings serve to protect blade tips from damage during rub contact between the blades and case. When the blade tips are protected from damage during rub, clearance between the blades and case ID can be set closer and tighter operating clearance can be achieved.

To limit blade damage, the adjacent surfaces of the surrounding shroud may be formed by an abradable rub coating. Examples of abradable rub coatings are found in U.S. Pat. Nos. 3,575,427, 6,334,617, and 8,020,875. One exemplary baseline coating comprises a silicone matrix with glass micro-balloon filler. Without the glass filler, the elastic properties of the abradable coating result in vibrational resonances and non-uniform rub response. The glass increases the effective modulus of the coating so as to reduce deformation associated with aerodynamic forces and resonances. More recent proposals include filler such as polymer micro-balloons (PCT/US2013/023570) and carbon nanotubes (PCT/US2013/023566).

For interfacing with the abradable rub coating, the blade tips may bear an abrasive coating. US Patent Application Publication 2013/0004328 A1, published Jan. 3, 2013, and entitled "ABRASIVE AIRFOIL TIP" discloses a number of such coatings.

SUMMARY

One aspect of the disclosure involves a method for manufacturing a blade. The blade comprises: an airfoil having: a root end and a tip; a metallic substrate along at least a portion of the airfoil; and an anodized layer. The method comprises: roughening the tip to form protrusions; and anodizing to form the anodized layer so that the protrusions form an abrasive.

A further embodiment may additionally and/or alternatively include the anodized layer being along surfaces of the airfoil beyond the tip.

A further embodiment may additionally and/or alternatively include the roughening comprising raising a burr.

A further embodiment may additionally and/or alternatively include the raising the burr comprising indenting.

A further embodiment may additionally and/or alternatively include the raising the burr comprising indenting and drawing.

A further embodiment may additionally and/or alternatively include the raising the burr comprising forming an intersecting pattern.

A further embodiment may additionally and/or alternatively include the raising the burr comprising forming regular pattern.

A further embodiment may additionally and/or alternatively include the bur comprising a plurality of burrs with a characteristic height of 0.05 mm to 0.15 mm.

A further embodiment may additionally and/or alternatively include the roughening raising at 5% to 25% of the tip surface by at least 0.05 mm.

A further embodiment may additionally and/or alternatively include the roughening comprising an additive process.

A further embodiment may additionally and/or alternatively include the additive process applying a discontinuous material.

A further embodiment may additionally and/or alternatively include the discontinuous material covering 5% to 25% of the tip surface.

A further embodiment may additionally and/or alternatively include the discontinuous material forming at least 100 discrete locations on the tip surface.

A further embodiment may additionally and/or alternatively include the anodizing converting the entire tip surface to alumina to a depth of at least 0.025 mm.

A further embodiment may additionally and/or alternatively include the anodizing converting the entire tip surface to by-volume majority alumina to a depth of 0.025 mm to 0.05 mm.

A further embodiment may additionally and/or alternatively include the roughening creating the protrusions with characteristic heights of 0.05 mm to 0.15 mm.

A further embodiment may additionally and/or alternatively include applying a polymeric coating to a pressure side and a suction side of the airfoil.

A further embodiment may additionally and/or alternatively include a blade manufactured according to the method.

A further embodiment may additionally and/or alternatively include a rotor comprising a circumferential array of the blades.

A further embodiment may additionally and/or alternatively include protrusions of the abrasive differing in distribution amongst the blades.

A further embodiment may additionally and/or alternatively include a gas turbine engine comprising the rotor and a case encircling the rotor. The case has: a substrate and a coating on an inner surface of the substrate facing the rotor.

A further embodiment may additionally and/or alternatively include causing the tip coating to abrade an adjacent coating.

Another aspect of the disclosure involves a method for manufacturing a turbomachine component. The component comprises a metallic substrate and an anodized layer. The method comprises roughening a surface of the substrate and anodizing the roughened surface to form the anodized layer including an abrasive.

A further embodiment may additionally and/or alternatively include the roughening being a non-subtractive displacement of material.

A further embodiment may additionally and/or alternatively include the method being a method for manufacturing and using the turbomachine component, the method further comprising rubbing the anodized roughened surface against a mating surface to abrade the mating surface.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
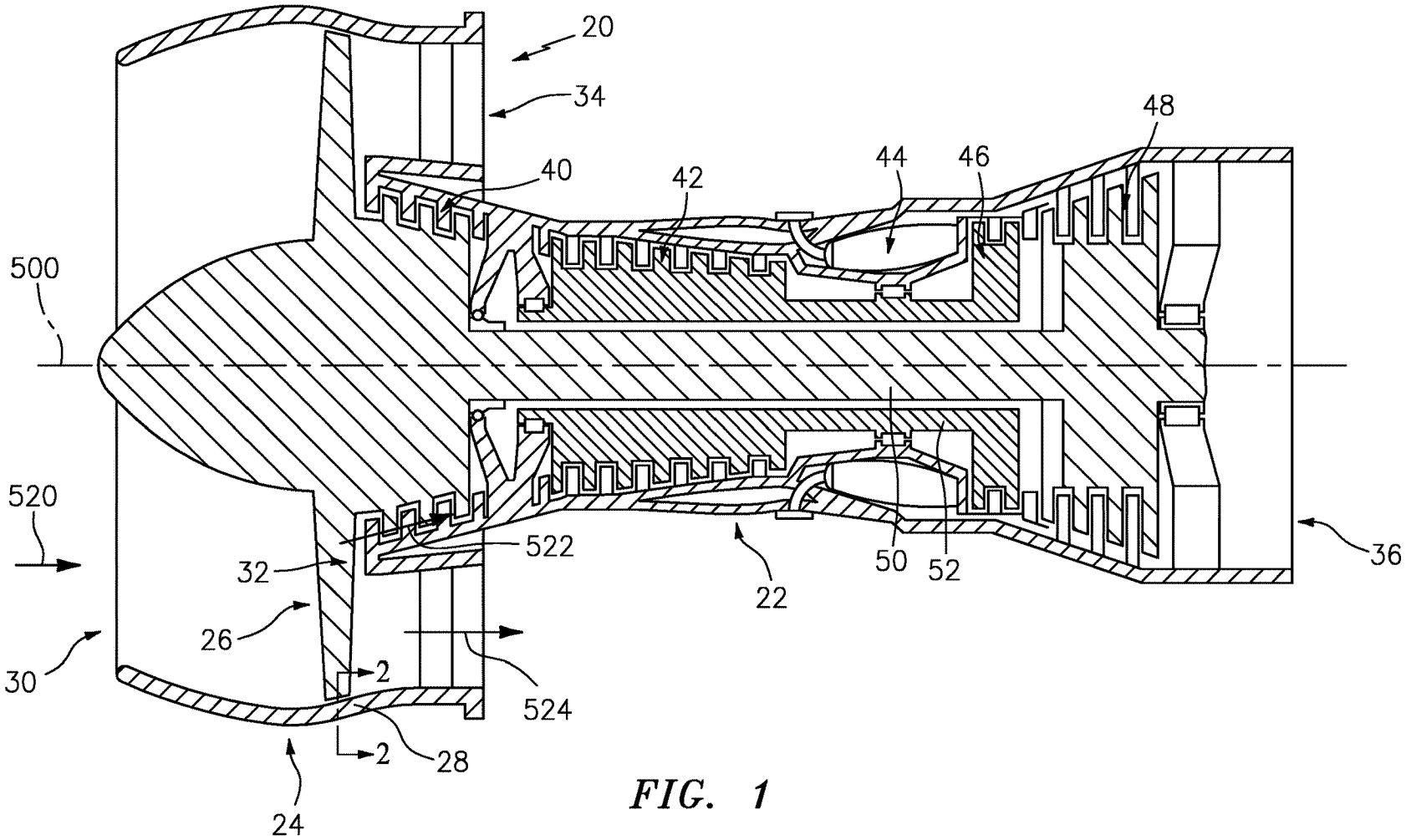
FIG. 1 is a partially schematic half-sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
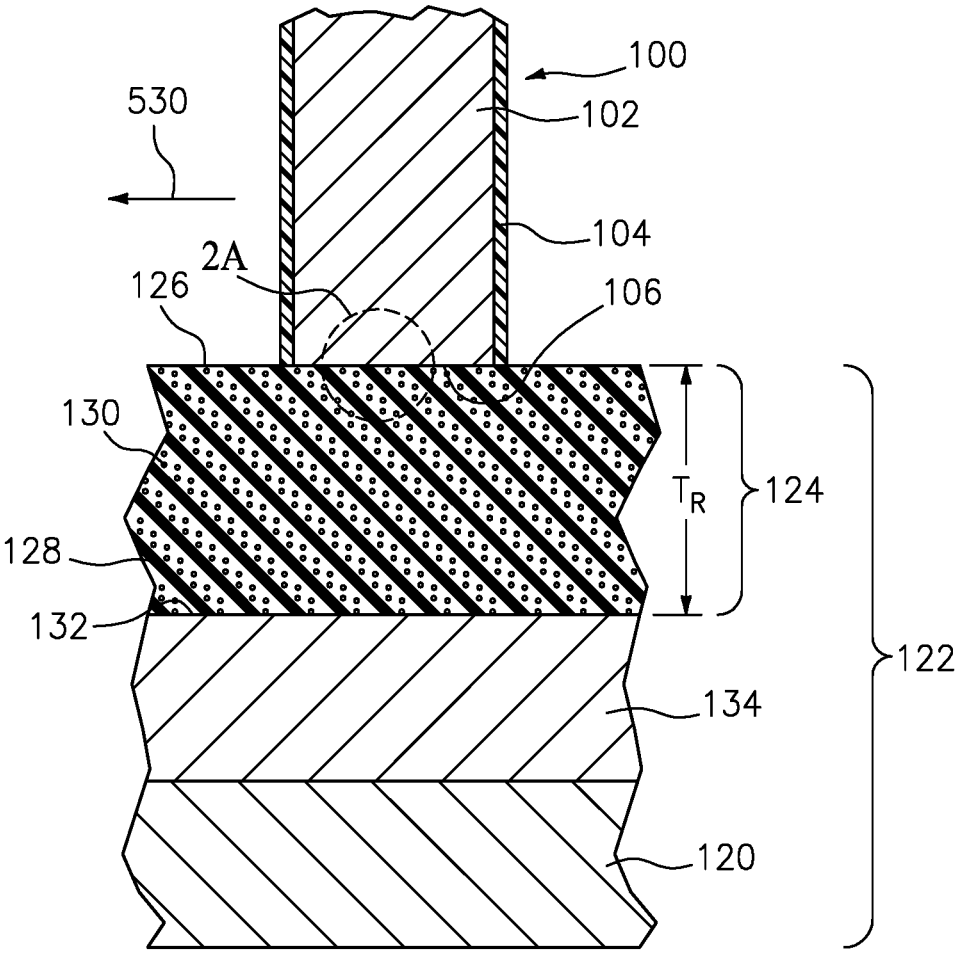
FIG. 2 is an enlarged transverse cutaway view of a fan blade tip region of the engine of FIG. 1 taken along line 2-2 and showing a first rub coating.

FIG. 2 shows a cutaway blade 100 showing a blade substrate (e.g., an aluminum alloy) 102 and a polymeric coating 104 (e.g., a polyurethane-based coating) on the substrate. The exemplary coating is along pressure and suction sides and spans the entire lateral surface of the blade between the leading edge and trailing edge. The exemplary coating, however, is not on the blade tip 106. If originally applied to the tip, the coating may have been essentially worn off during rub. Circumferential movement in a direction 530 is schematically shown.

FIG. 2 also shows an overall structure of the fan case facing the blade. This may include, in at least one example, a structural case 120. It may also include a multi-layer liner assembly 122. An inboard layer of the liner assembly may be formed by a rub material 124. The exemplary rub material 124 has an inboard/inner diameter (ID) surface 126 facing the blade tips and positioned to potentially rub with such tips during transient or other conditions.

The exemplary rub material 124 comprises a polymeric matrix material 128 and a filler 130 (e.g., polymeric particles or micro-balloons or glass micro-balloons). The exemplary rub material may be formed as a coating on an ID surface 132 of a substrate 134 of the liner assembly. An exemplary substrate 134 is titanium alloy AMS 4911. The rub material is shown as having an overall thickness TR. Exemplary $T_R$ is 1-10 mm, more particularly, 3-6 mm. Alternative abradable rub material may include metal matrix composites (e.g., formed by thermal spray coating).

Figure 2A:
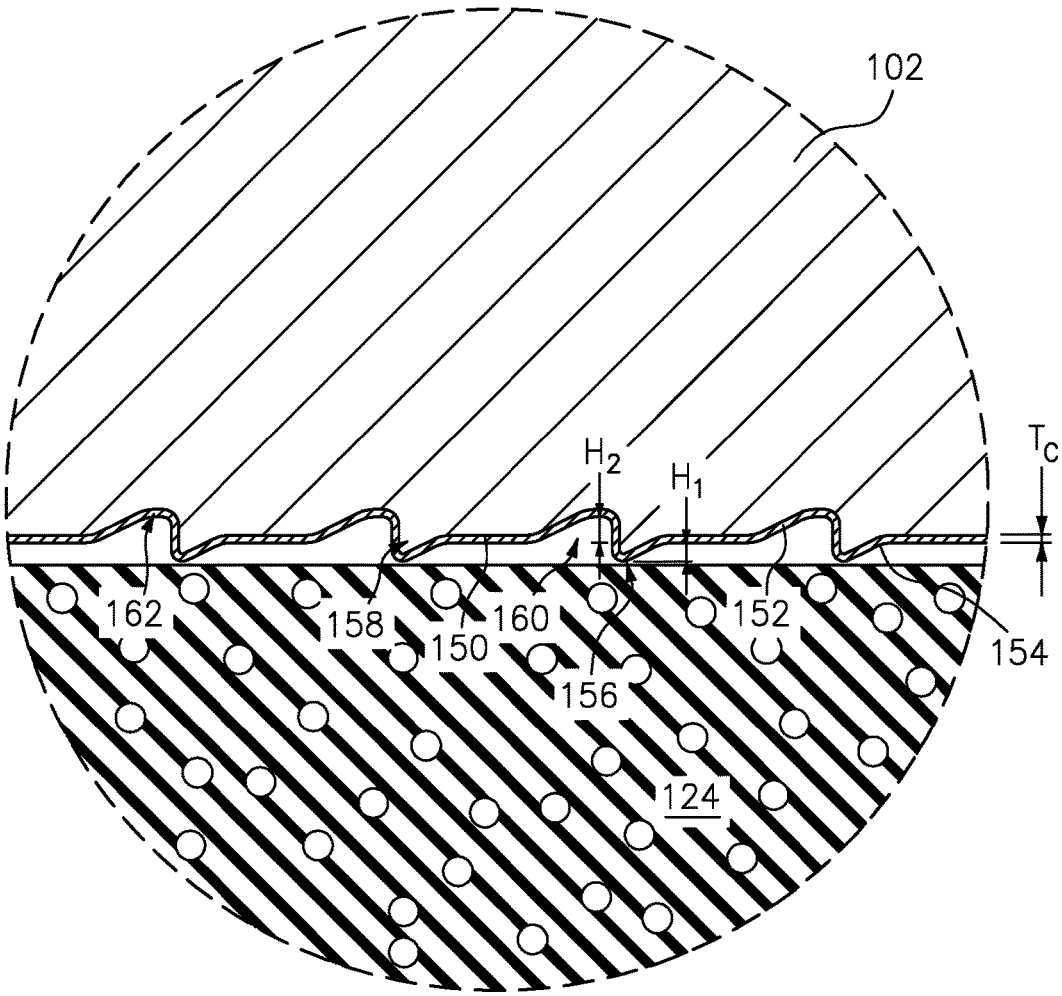
FIG. 2A is an enlarged view of a blade tip region of FIG. 2 showing burrs.

FIG. 2A shows the tip region 106 with a tip surface 150 of the substrate bearing a layer 152. The layer 152 has a surface 154 with protrusions 156. As is discussed further below, these protrusions may correspond to protrusions ("asperities") in the pre-anodize substrate and may pattern such protrusions 158 remaining in the substrate. The protrusions 156 form abrasive for abrading the abradable rub material 124. Recesses 160 in the surface 154 adjacent the protrusions 156 pattern associated recesses 162 in the substrate.

The layer 152 has a thickness $T_c$ away from the protrusions 154. Exemplary $T_c$ is 0.5-2.0 mils (13 micrometers to 51 micrometers), more particularly, 20 micrometers to 50 micrometers or 20 micrometers to 35 micrometers.

The exemplary layer 152 is not merely localized to the tip but may extend along all or majority areas of those areas of the substrate that form the pressure and suction sides.

The exemplary protrusions 158 are formed by roughening an initial smooth substrate surface. Exemplary roughening comprises plastically deforming. Exemplary plastically deforming (FIGS. 3-4) displaces material from initial surface 150' to form protrusions 158' which are precursors of the protrusions 158. The displacement leaves recesses 162' that serve as precursors of recesses 162. Exemplary height $H_1'$ of protrusions 158 and 158' respectively above a majority level of the surface 150 and 150' may be similar to $H_1$.

Exemplary asperity height $H_1$ is 1-10 mils (0.025 mm to 0.25 mm), more narrowly 2-4 mils (0.05 mm to 0.13 mm) or 2-6 mils (0.05 mm to 0.15 mm) and as broad as 0.5-20 mils (0.013 mm to 0.51 mm) above a majority level of the associated surface. Coverage may be more specifically defined as area at half of asperity height compared with the total tip area.

Examples of mechanical deformation include raising a burr with a cutting tool such as is done in making a file. This may be done as discrete local asperities or as ridges. Ridges may be formed by a drawing operation where a tool is drawn across the surface (e.g., in a line (straight or arcuate)) or may be formed using an elongate edge tool. The drawing may be fully across the surface or may be a shorter drawing to leave closed-ended elongate recesses or indentations and associated protrusions.

One example of an arcuate recess is one that is along or generally follows the median of the tip platform (e.g., the shape of the tip end face of airfoil). For example, a series of ridges and associated grooves may be along the median and then spaced proportionately between the median and the respective suction side perimeter or pressure side perimeter of the tip. For either such arcuate features or for the other features described above, it may be advantageous to keep the distribution of such features spaced away from the tip perimeter to improve fatigue life (reduce/minimize debit in fatigue life associated with the asperities). Bending stresses on the blade at the tip will generally be minimum near the median and progressively greater toward the pressure side perimeter and suction side perimeter (typically going into tension in one direction and compression in the opposite direction). Keeping the asperities away from the perimeter reduces the possibility of crack initiation at these high stress locations. An exemplary amount of recessing keeps the asperities recessed from the perimeter by approximately one-eighth of the local blade thickness, more broadly, one-eighth to one-quarter. As the amount of recessing is initially increased from zero, it will be a progressive benefit. However, at some point, the benefit will reduce and also have to be weighed against the detriment of losing the abrasive capability. Thus, the exemplary one-eighth recessing creates an abrasive zone of 75% of the local blade thickness while the one-quarter recessing yields 50%. An alternative lower limit on beneficial recessing may be 5% or 10% rather than the one-eighth. Alternative upper limits may reach one-third.

Figure 3:
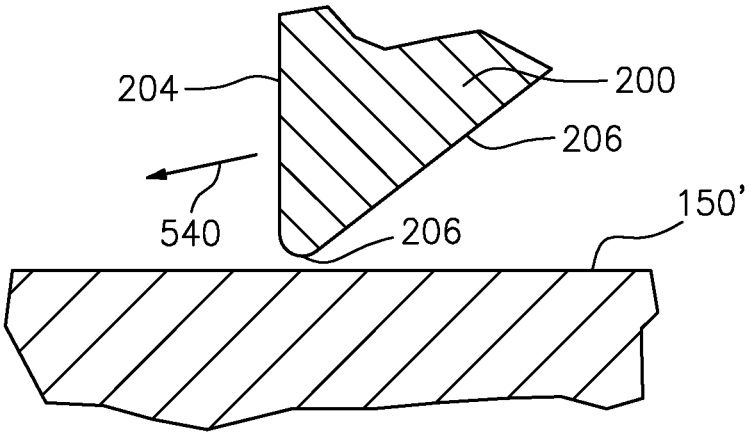
FIG. 3 is a partial sectional view of a first stage of burr formation.
Figure 4:
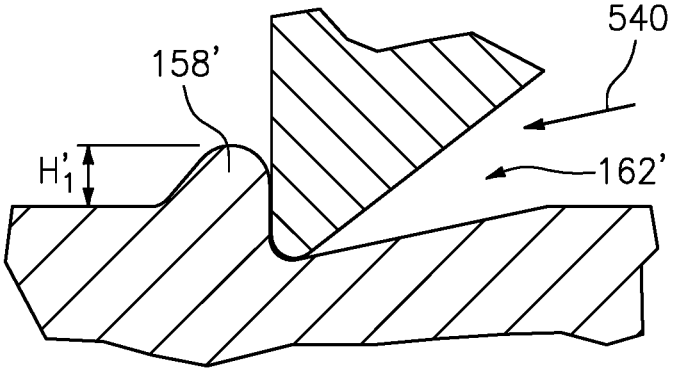
FIG. 4 is a partial sectional view of a second stage of burr formation.
Figure 5:
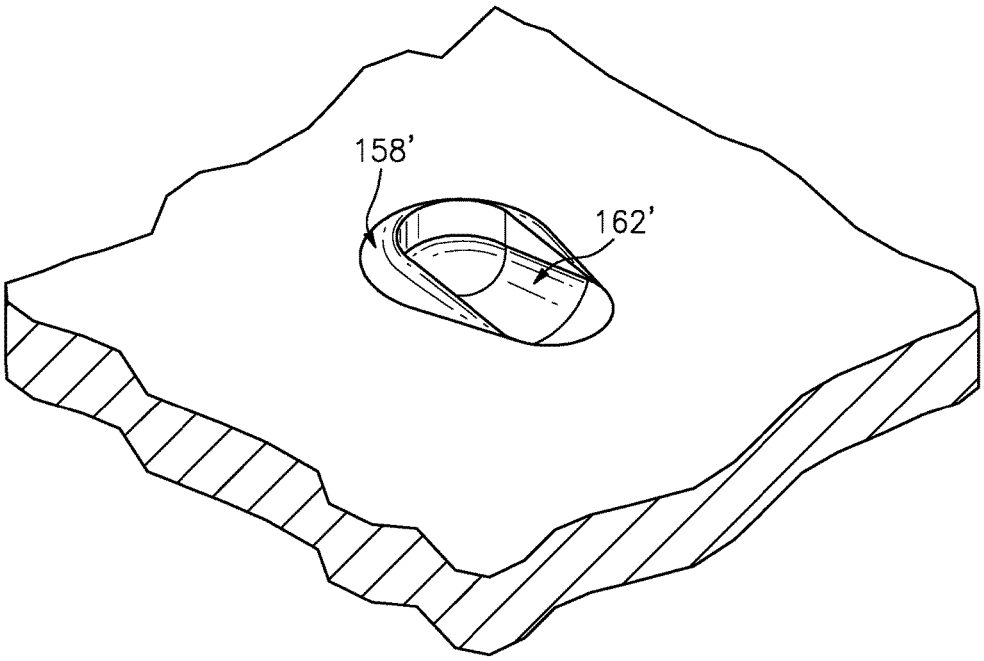
FIG. 5 is a partial view of a surface having the formed burr.

FIGS. 3 and 4 show a tool 200 having a tip 202, a leading surface 204, and a trailing surface 206. Lateral (side) surfaces are not shown. The exemplary tool is plunged into the surface 150' by translation in a direction 540 (FIG. 4). Exemplary direction 540 is slightly off parallel to the surface (e.g., by an exemplary 5° to 20°). However, a broader range of angles including normal indentation is possible. Exemplary movement raises the protrusion 158' as a burr ahead of the tool. With an exemplary narrow indenter, FIG. 5 shows the burr 158' as generally crescent-shaped with a base at the leading end of the recess 162 and two sides or arms extending back along the sides of the recess 162 and vertically and horizontally tapering toward the trailing end of the recess 162'.

Figures 6, 6A:
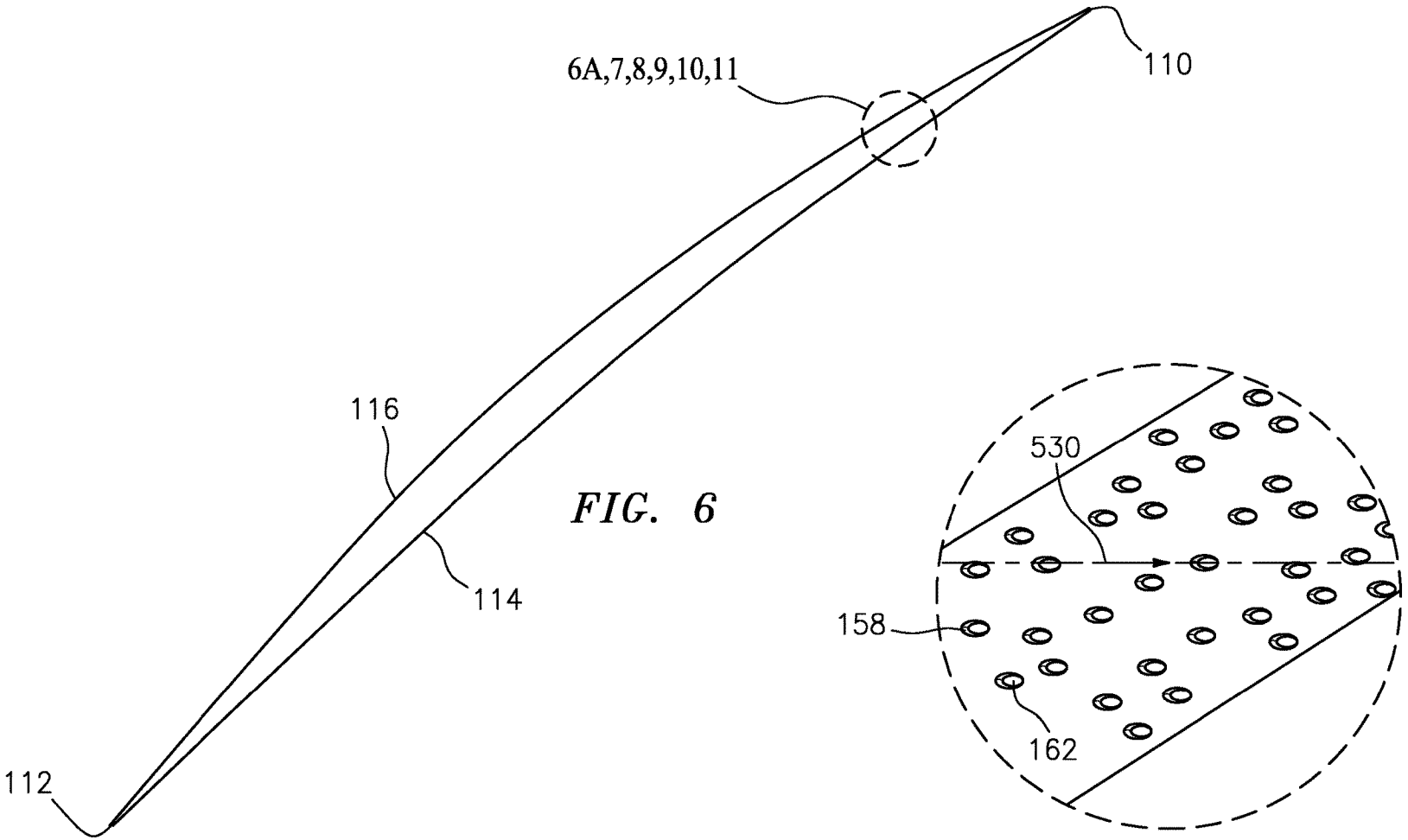
FIG. 6 is a tip end view of a first coated airfoil.
FIG. 6A is an enlarged view of the airfoil of FIG. 6.
Figure 7:
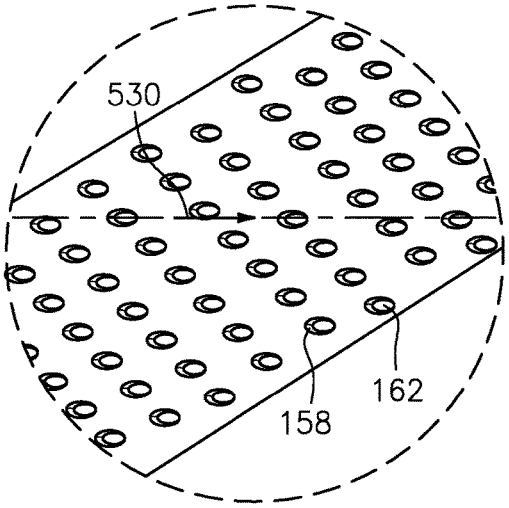
FIG. 7 is an enlarged tip end view of a second coated airfoil.

FIG. 6 is an end view of a tip with FIG. 6A showing the pattern of protrusions and recesses in the direction of blade motion in the ultimate engine as shown as 550. FIG. 6 further shows the blade leading edge 110, trailing edge 112, pressure side 114, and suction side 116. The exemplary protrusions and recesses are aligned with the recesses ahead of the protrusions in that direction. The exemplary recesses are patterned so that one or more of several properties may be achieved. First, the recesses are of sufficient density so as to at least partially overlap in location transverse to the direction 530. In this way, all areas of the abradable material swept by the tip will encounter protrusions. This helps avoid uneven wear of the abradable material. Furthermore, the pattern may be selected so that, overall, any given axial location along the abradable material encounters similar numbers of protrusions so as to also promote even wear. Thus having rows of protrusions parallel to direction 500 would not be particularly desirable. Offset rows oriented differently (FIG. 7), may however, provide some benefit as is discussed further below in the context of elongate protrusions.

Figure 8:
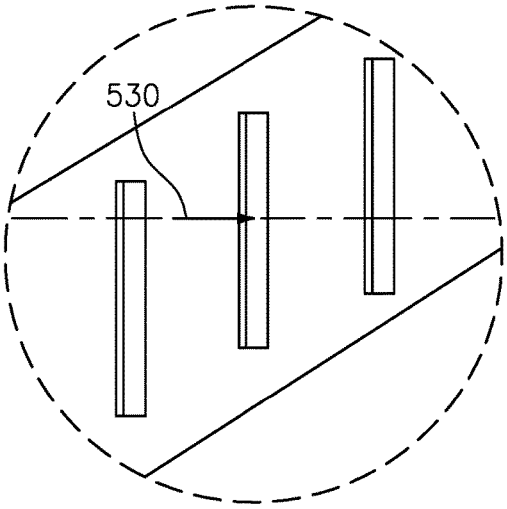
FIG. 8 is an enlarged tip end view of a third coated airfoil.

FIG. 8 shows elongate protrusion-recess pairs oriented axially (normal to the direction 530). The axial configuration offers benefits of simplicity of design as it is conceptually easy to achieve smooth and uninterrupted axial coverage over the width of the mating abradable. Furthermore, it is conceptually simple to increase or reduce the spacing of protrusion-recess pairs to provide an optimal balance between the volume of abradable cut and the required number of protrusions doing the cutting. For example, if too few protrusions are provided for cutting a desired amount of abradable, the protrusions may exhibit excessive wear. In that case, protrusion spacing would be reduced to provide more protrusions to share the work of cutting. Conversely, if too many protrusions are provided, the abradables may deplete at an excessive rate while the protrusions may have longer lifespans than anticipated. In that case, the protrusion spacing could be increased.

Figure 9:
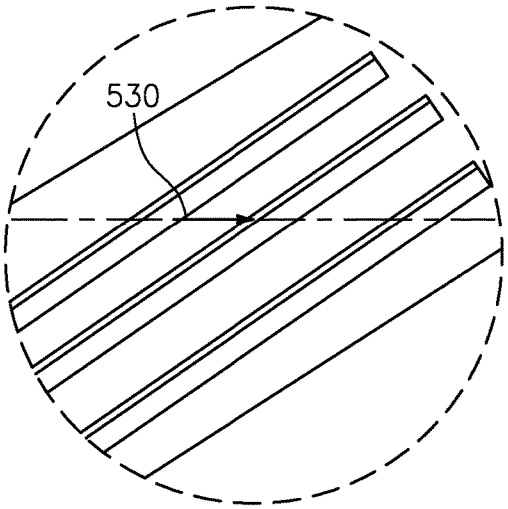
FIG. 9 is an enlarged tip end view of a fourth coated airfoil.

FIG. 9 shows such pairs oriented generally chordwise. The chordwise orientation offers the benefits of conceptually simple design, low cost manufacturing, complete coverage across the axial width of the blade path, may minimized fatigue life debit when the features are located near the center of the tip width. Furthermore, chordwise ridges act as labyrinth seal features and provide reduction in air leakage over the tip of the airfoil.

Figure 10:
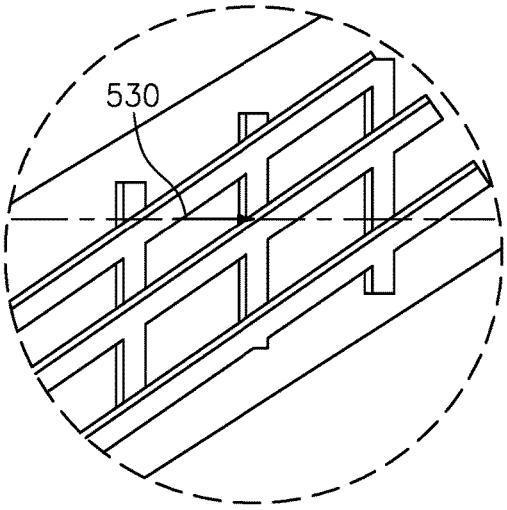
FIG. 10 is an enlarged tip end view of a fifth coated airfoil.

FIG. 10 shows a combination of intersecting axial and chordwise pairs.

Formation of protrusions without corresponding recesses may be achieved by additive methods. Additive methods include plasma spray, laser powder sintering, electro-spark deposition, and sputtering.

Figure 11:
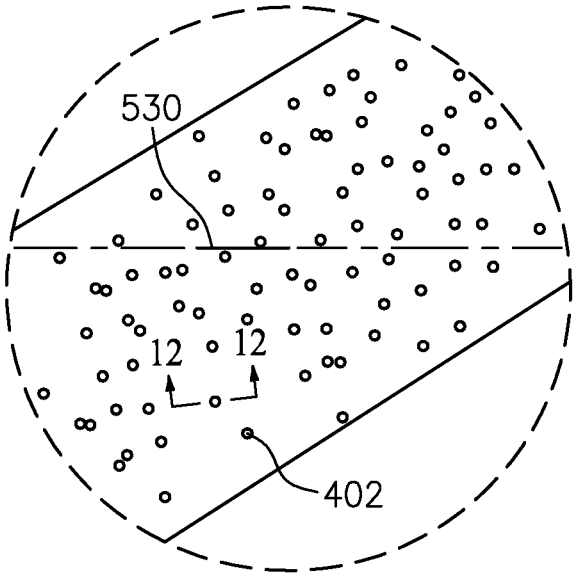
FIG. 11 is an enlarged tip end view of a sixth coated airfoil.

FIG. 11 shows a pattern of individual protrusions 400 formed by an additive process.

Figure 12:
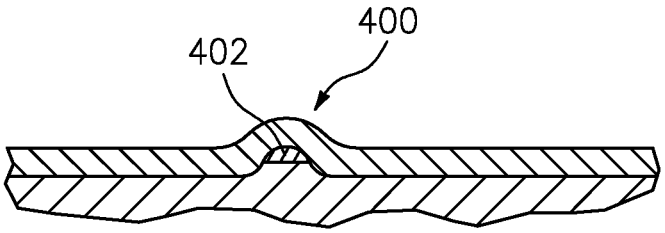
FIG. 12 is a partial sectional view of a protrusion on the tip end of the airfoil of FIG. 11, taken along line 12-12.
Figure 13:
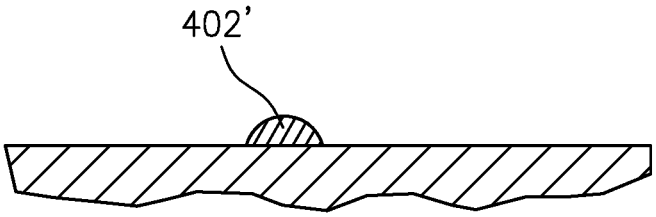
FIG. 13 is a sectional view of a droplet precursor of the protrusion of FIG. 12.

FIG. 12 shows a protrusion 400 in the oxide layer and a small remaining portion of a protrusion 402 formed by a droplet 402' (FIG. 13) applied to the original substrate tip.

Alternative, but likely more costly, subtractive methods may remove material from the surface to leave high points. Exemplary subtractive methods include micro-machining, etching, laser ablation, and electro-discharge machining (EDM) to roughen the surface to create protrusions such as those discussed above for displacement processes or additive processes.

An exemplary manufacture process involves forming the blade substrate by conventional means (e.g., forging and/or machining and peening). Some blade configurations have a titanium leading edge separated from an aluminum substrate by a slight gap (e.g., epoxy-filled for galvanic isolation). Asperities may be formed in the metal of the tip surface by incursion of a tool. An exemplary tool may be a conical diamond tool with included angle of 60 degrees (more broadly, an exemplary 45° to 75°) and tip radius of 0.001 inch (0.024 mm) (more broadly, 0.01 mm to 0.10 mm or 0.01 mm to 0.05 mm).

Repeated incursion at an exemplary 30 degree angle to the tip surface (more broadly, 5° to 50° or 15° to 45° or 20° to 40°) creates asperities raised from the tip surface by 0.003 inch (0.08 mm) (more broadly, 0.04 mm to 0.20 mm or 0.05 mm to 0.15 mm). This is repeated until the tip is covered by asperities at a spacing of about 0.010 inch (0.25 mm). The tip of the blade is then treated by a sulfuric acid anodize process to create a 0.001 inch (0.025 mm) thick (more broadly, 0.02 mm to 0.04 mm or 0.01 mm to 0.05 mm) layer of aluminum oxide on the asperities. The gas path surfaces and Ti leading edge may be masked to prevent interaction with the anodize process.

Exemplary masking methods may include silicone masking tape and wax dipping to protect the majority of the part.

For blades having polymer coatings on the airfoil pressure and suction side surfaces, such coating could also be used to mask if the polymer coating was applied before rather than after the anodize process.

Relative to uncoated tips or alternative coatings the exemplary coating may have one or more of several advantages. For example, the hard coated asperities act as an abrasive when in rub interaction with an abradable outer air seal and result in a reduced blade temperature rise compared with an untreated blade tip. This reduced temperature rise is sufficient in one example to suppress the blade temperature to below 350° F. (177° C.) which prevents the thermally induced spallation of a polyurethane erosion resistant coating on the gas path surfaces. Another advantage is improved durability compared with polymer bonded abrasive tip materials. The polymer bonded materials have an inherent temperature limitation associated with the softening of the polymer matrix. This limits their use to the coolest stages of the engine and also results in a wear ratio with the outer air seal material in the range of 0.05 to 0.01. The present hard coated asperity tip material may exhibit a very small wear ratio with the outer air seal in the order of 0.0001. This is advantageous for the retention of blade length during rub interaction. The hard coated asperities do not suffer the same temperature limitation and may be used throughout the engine.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A method for manufacturing a blade, the blade comprising:

an airfoil having:

a root end and a tip;

a metallic substrate along at least a portion of the airfoil; and an anodized layer;

the method comprising:

roughening the tip to form protrusions with characteristic heights of 0.025 mm to 0.25 mm, the roughening comprising raising a burr, the raising the burr comprising indenting; and anodizing to form the anodized layer so that the protrusions form an abrasive.

2. The method of claim 1 wherein:

the anodized layer is along surfaces of the airfoil beyond the tip.

3. The method of claim 1 wherein:

the raising the burr further comprises drawing.

4. The method of claim 1 wherein:

the raising the burr comprises forming an intersecting pattern.

5. The method of claim 1 wherein:

the raising the burr comprises forming regular pattern.

6. The method of claim 1 wherein:

the burr comprises a plurality of burrs with a characteristic height of 0.05 mm to 0.15 mm.

7. The method of claim 1 wherein:

the roughening raises at 5% to 25% of the tip surface by at least 0.05 mm.

8. The method of claim 1 wherein:

the anodizing converts the entire tip surface to by-volume majority alumina to a depth of 0.025 mm.

9. The method of claim 1 wherein:

the roughening creates said protrusions with characteristic heights of 0.05 mm to 0.15 mm.

* * * * *